US006842096B2

(12) United States Patent
Ciarcia et al.

(10) Patent No.: US 6,842,096 B2
(45) Date of Patent: Jan. 11, 2005

(54) CIRCUIT BREAKER MAGNETIC TRIP ASSEMBLY

(75) Inventors: Ronald Ciarcia, Bristol, CT (US); Luis Brignoni, Toa Baja, PR (US); Narender Macha, Hyderbad (IN); Anantharam Subramanian, Secunderabad (IN); Samuel Stephen Kim, Bristol, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/436,642

(22) Filed: May 13, 2003

(65) Prior Publication Data

US 2004/0227602 A1 Nov. 18, 2004

(51) Int. Cl.[7] ..... H01H 73/48
(52) U.S. Cl. ..... 335/35; 335/174; 335/23
(58) Field of Search ..... 335/6, 23–25, 335/35–42, 165–176

(56) References Cited

U.S. PATENT DOCUMENTS

| | | | | | |
|---|---|---|---|---|---|
| 4,479,101 | A | * | 10/1984 | Checinski | 335/37 |
| 4,503,408 | A | * | 3/1985 | Mrenna et al. | 335/35 |
| 4,504,807 | A | * | 3/1985 | Nar | 335/61 |
| 4,616,199 | A | * | 10/1986 | Oster | 335/35 |
| 6,218,919 | B1 | | 4/2001 | Ciarcia et al. | |

* cited by examiner

*Primary Examiner*—Lincoln Donovan
(74) *Attorney, Agent, or Firm*—Cantor Colburn LLP

(57) ABSTRACT

A magnet assembly for actuating a trip latch in a circuit breaker. The magnet assembly includes a core and an armature. The core is disposed around a conductor forming a primary current path in the circuit breaker, and includes an end forming a pole face. The armature is biased by a force acting in a direction away from the pole face. The armature includes a generally planar surface and a projection extending from the generally planar surface toward the pole face. The generally planar surface is separated from the pole face by a first air gap, and the projection is separated from the pole face by a second air gap. The first air gap is larger than the second air gap.

18 Claims, 10 Drawing Sheets

CIRCUIT BREAKER MAGNETIC TRIP ASSEMBLY

BACKGROUND OF THE INVENTION

The present invention relates to circuit breakers and, more particularly, to magnetic trip assemblies for circuit breakers.

Circuit breakers typically provide instantaneous, short time, and long-time protection against high currents produced by various conditions such as short-circuits, ground faults, overloads, etc. In a circuit breaker, a trip unit is the device that senses current (or other electrical condition) in the protected circuit and responds to high current conditions by tripping (unlatching) the circuit breaker's operating mechanism, which in turn separates the circuit breaker's main current-carrying contacts to stop the flow of electrical current to the protected circuit. Such trip units are required to meet certain standards, e.g., UL/ANSI/IEC, which define trip time curves specifying under what conditions a trip must occur, i.e., short time, long time, instantaneous, or ground fault, all of which are well known.

One type of trip unit used for instantaneous and/or short time overcurrent protection is known as a magnetic trip assembly (magnet assembly). A magnet assembly may be used in conjunction with a thermal trip assembly, such as a bimetallic element, which provides long time overcurrent protection. The combination of the magnetic trip assembly and the thermal trip assembly is commonly referred to as a thermal and magnetic trip unit.

The magnet assembly typically includes a magnet core (yoke) disposed about a current carrying strap, an armature (lever) pivotally disposed on the core, and a spring arranged to bias the armature away from the magnet core. The magnet core is typically U-shaped, with one leg forming a pole face. The armature is typically a planar structure having a flat surface opposing the pole face. Upon the occurrence of a short circuit condition, very high currents pass through the strap. The increased current causes an increase in the magnetic field in the air gap between the pole face and the flat-face of the armature. The magnetic field acts to rapidly draw the armature towards the magnet core, against the bias of the spring. As the armature moves towards the core, the end of the armature moves an associated trip latch, which unlatches the operating mechanism causing the main current-carrying contacts to separate.

While such magnetic trip assemblies work well for high ampere ratings, they may not generate enough force to trip the breaker at lower amperages (e.g., 12.5 times the circuit breaker ampere rating for current ratings 30 amps and above) because of the large air gap inherent in these designs. To overcome this drawback, magnet assemblies including multi-turn coils have been developed to affect a higher magnetic force. Such multi-turn coils are, however, more expensive than the core/armature design.

BRIEF SUMMARY OF THE INVENTION

The above discussed and other drawbacks and deficiencies are overcome or alleviated by a magnet assembly for actuating a trip latch in a circuit breaker. The magnet assembly includes a core and an armature. The core is disposed around a conductor forming a primary current path in the circuit breaker, and includes an end forming a pole face. The armature is biased by a force acting in a direction away from the pole face. The armature includes a generally planar surface and a projection extending from the generally planar surface toward the pole face. The generally planar surface is separated from the pole face by a first air gap, and the projection is separated from the pole face by a second air gap. The first air gap is larger than the second air gap. A magnetic field induced in the first and second air gaps by the passage of electrical current through the conductor moves the armature against the force to actuate the trip latch. The armature may be generally L-shaped, with one end of the armature being pivotally secured proximate an opposite end of the core and the other end forming the projection. The core may be generally U-shaped, with a portion of a leg of the core including the pole face being bent to offset the portion by a distance greater than about the thickness of the projection. The projection is received in a space formed by the offset.

In one embodiment, the force is applied by a spring coupled between the armature and the opposite end of the core. The spring may be secured to the armature by a bracket. One end of the bracket and one end of the armature may extend through an aperture in the opposite end of the core with the bracket including a tab extending therefrom for retaining the armature and the bracket within the aperture.

BRIEF DESCRIPTION OF THE DRAWINGS

Referring to the drawings wherein like elements are numbered alike in the several Figures.

DETAILED DESCRIPTION OF THE INVENTION

Figure 1:
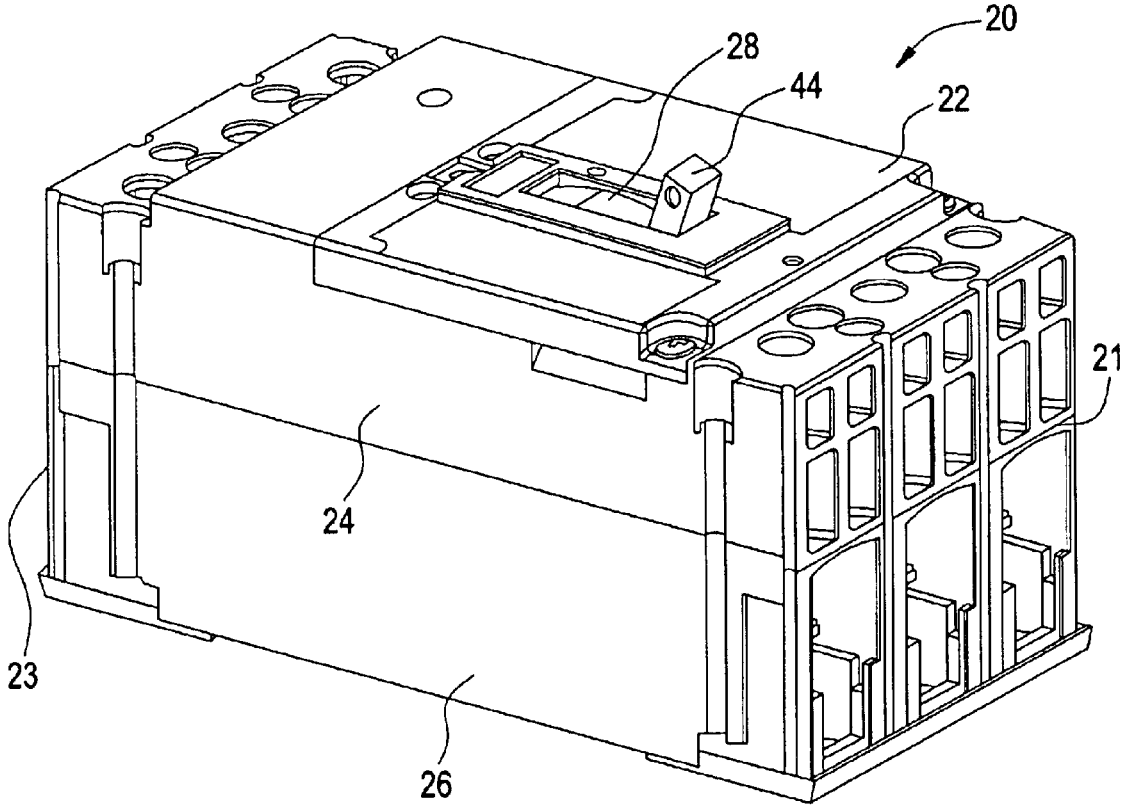
FIG. 1 is an isometric view of a molded case circuit breaker employing.

Referring to FIG. 1, a top perspective view of a molded case circuit breaker 20 is generally shown. Molded case circuit breaker 20 is generally interconnected within a protected circuit between multiple phases of a power source (not shown) at line end 21 and a load to be protected (not shown) at load end 23. Molded case circuit breaker 20 includes a base 26, a mid cover 24 and a top cover 22 having a toggle handle (operating handle) 44 extending through an opening 28.

Figure 2:
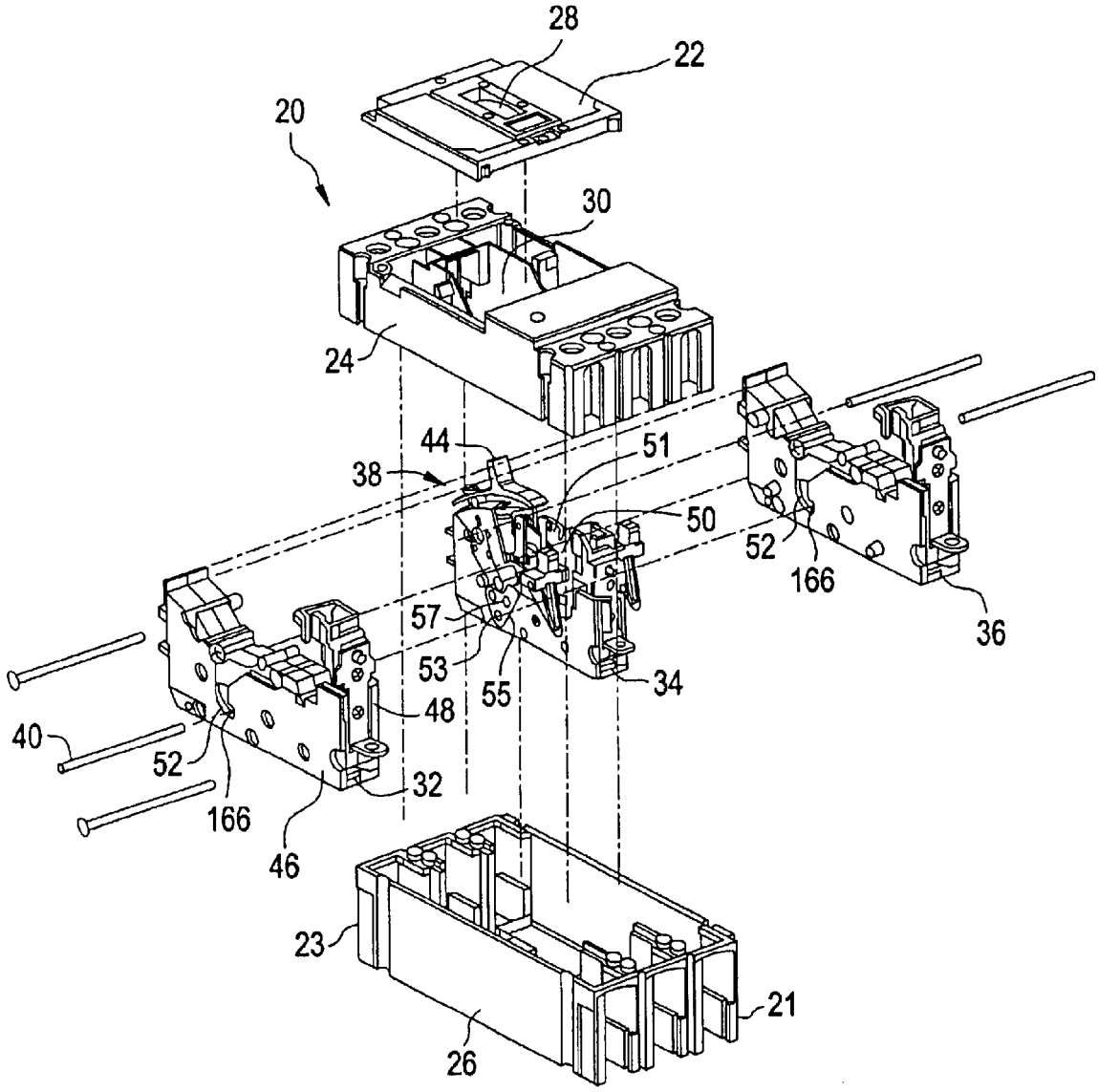
FIG. 2 is an exploded view of the circuit breaker of FIG. 1.

FIG. 2 shows an exploded view of the circuit breaker 20. Disposed within base 26 are a number of cassettes 32, 34, and 36, corresponding to the number of poles (phases of current) in the electrical distribution circuit into which circuit breaker 20 is to be installed. The example shown corresponds to a 3-pole system (i.e., three phases of current), and has three cassettes 32, 34 and 36 disposed within base 26. It is contemplated that the number of cassettes can vary corresponding to the number of phases. Cassettes 32, 34 and 36 are commonly operated by an operating mechanism 38 via a cross pin 40. Cassettes 32, 34, 36 are typically formed of high strength plastic thermoset material and each include opposing sidewalls 46, 48. Sidewalls 46, 48 have an arcuate slot 52 positioned and configured to receive and allow the motion of cross pin 40 by action of operating mechanism 38.

Operating mechanism 38 is shown positioned atop and supported by cassette 34, which is generally disposed intermediate to cassettes 32 and 36. It will be appreciated, however, that operating mechanism 38 may be positioned atop and supported by any number of cassettes 32, 34, and 36. Toggle handle 44 of operating mechanism 38 extends through openings 28 and 30 and allows for mating electrical contacts disposed within each of the cassettes to be separated and brought into contact by way of movement of toggle handle 44 between "open" and "closed" positions. Operating mechanism 38 also includes a trip latch system 50, which allows a spring mechanism 51 in the operating mechanism 38 to be unlatched (tripped) to separate the contacts in each of the cassettes 32, 34 and 36 by way of spring force applied to rotors in each of the cassettes 32, 34, and 36 via cross pin 40. More specifically, cross pin 40 extends through an aperture 53 in a plate 55 and through apertures 166 disposed in rotor assemblies 164 (see FIG. 5) in each of the cassettes 32, 34, and 36. Plate 55 is pivotally mounted to a fixed pivot point 57 and is linked to a spring in the operating mechanism 38. Unlatching the operating mechanism 38 releases the spring to apply a force to pivot the plate 55 about its pivot point 57. As the plate 55 pivots about pivot point 57, the plate 55 drives the rotors via the cross pin 40 to separate the contacts in each of the cassettes. The spring mechanism 51 may be reset to a latched position by operation of the toggle handle 44 to a "reset" position. Operating mechanism 38 may operate, for example, as described in U.S. Pat. No. 6,218,919 entitled "Circuit Breaker Latch Mechanism With Decreased Trip Time".

Figure 3:
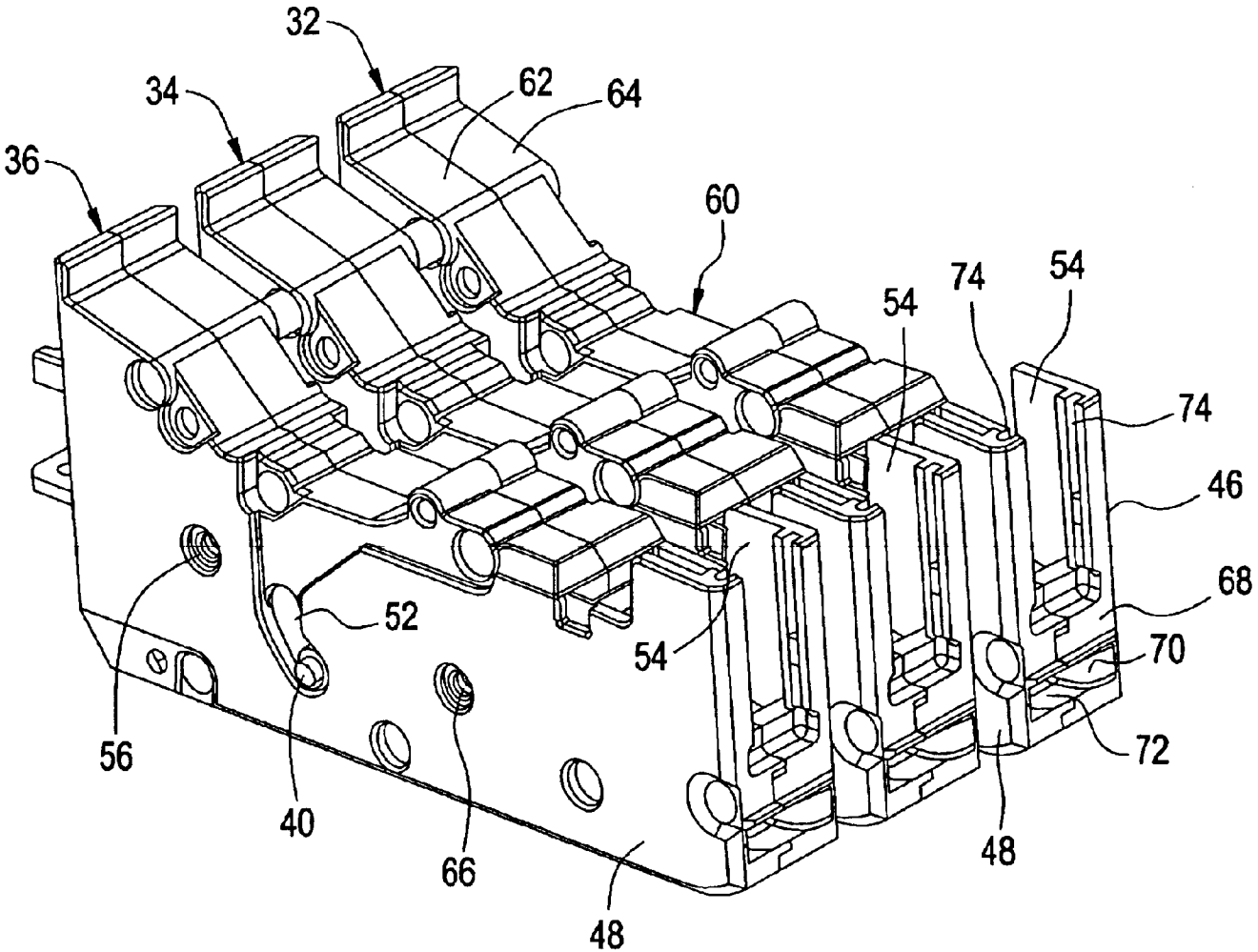
FIG. 3 is a perspective view of circuit breaker cassettes including a compartment for an integrated thermal and magnetic trip unit.

Referring now to FIG. 3, a perspective view of circuit breaker cassettes 32, 34, and 36 including compartments 54 for an integrated thermal and magnetic trip unit are shown. Each of the cassettes 32, 34, 26 include a housing 60 formed by two half-pieces 62, 64 joined by fasteners disposed through seven apertures 66 in the housing 60. A load-side end 68 of the housing 60 includes an outlet port 70 for an arc gas duct 72 formed in the housing 60. Disposed in the housing 60 above the outlet port 70 are a pair of opposing slots 74 that extend along an internal portion of sidewalls 46 and 48.

Figure 4:
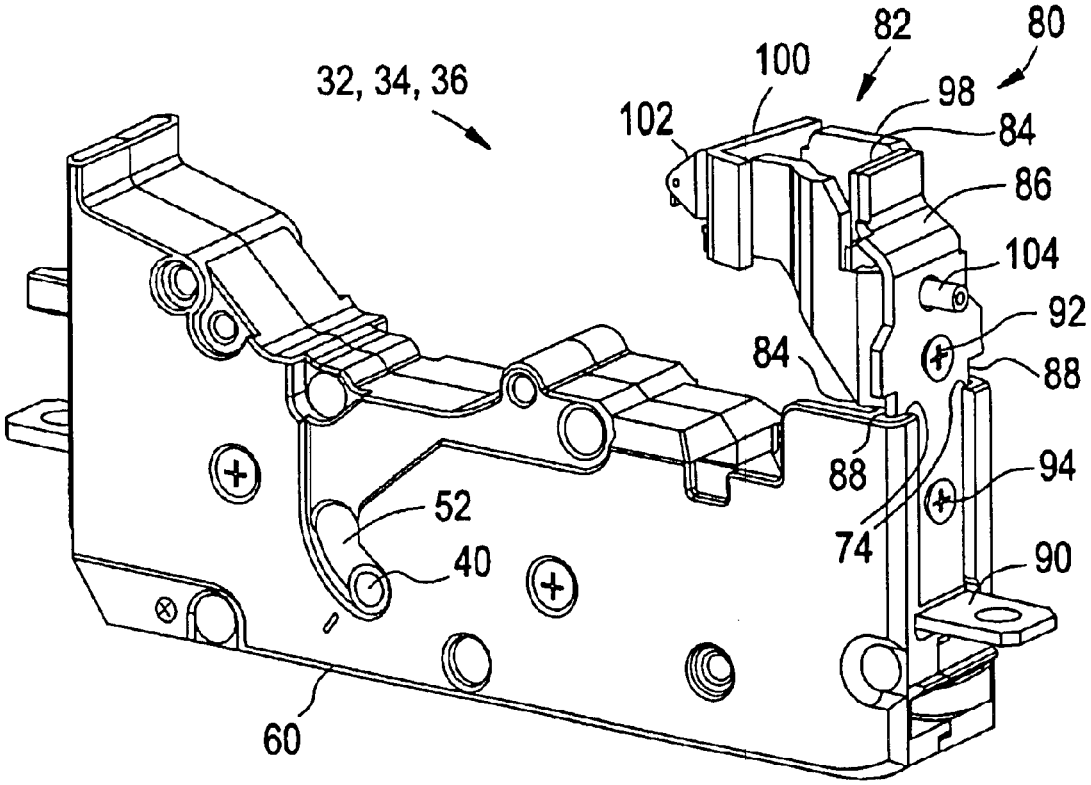
FIG. 4 is a perspective view of one of the circuit breaker cassettes including an integrated thermal and magnetic trip unit.

FIG. 4 is a perspective view of one of the circuit breaker cassettes 32, 34, or 36 supporting an integrated thermal and magnetic trip unit 80. Thermal and magnetic trip unit 80 includes a magnet assembly 82 and a bimetallic element 84 coupled to an end of a load terminal 86. Edges 88 of load terminal 86 are received within the opposing slots 74 formed in the housing 60 of the cassette 32, 34, or 36. A tab 90 extends from load terminal 86 for connection to wiring, a lug, or the like to form an electrical connection with the protected load. Fasteners 92, 94 secure the magnetic assembly 82 to the load terminal 86, and secure the load terminal 86 to a flux shunt 96 (shown in FIG. 6). Flux shunt 96 is a strip of magnetic material that extends along a length of the load terminal 86, between the load terminal 86 and the bimetallic element 84 to prevent electromagnetic forces developed by current flowing through the load terminal 86 and bimetallic element 84 from deflecting the bimetallic element 84.

Magnet assembly 82 includes a core 98 that extends around the bimetallic element 84, an armature 100 pivotally disposed on a leg 180 of the core 98, and a spring assembly 102 disposed on the armature 100. Spring assembly 102 acts to bias armature 100 away from a leg 188 of the core 98. A threaded set screw 104 extends through a hole in the load terminal 86 and a threaded hole in the core 98, and comes into contact with the bimetallic element 84. The set screw 104 is used for calibrating the bimetallic element 84. In some cases where a high resistance low amp bimetal is used, an insulator is inserted between the set screw 104 and bimetallic element 84 to prevent a parallel current path through the set screw 104 from damaging to the bimetal.

Figure 5:
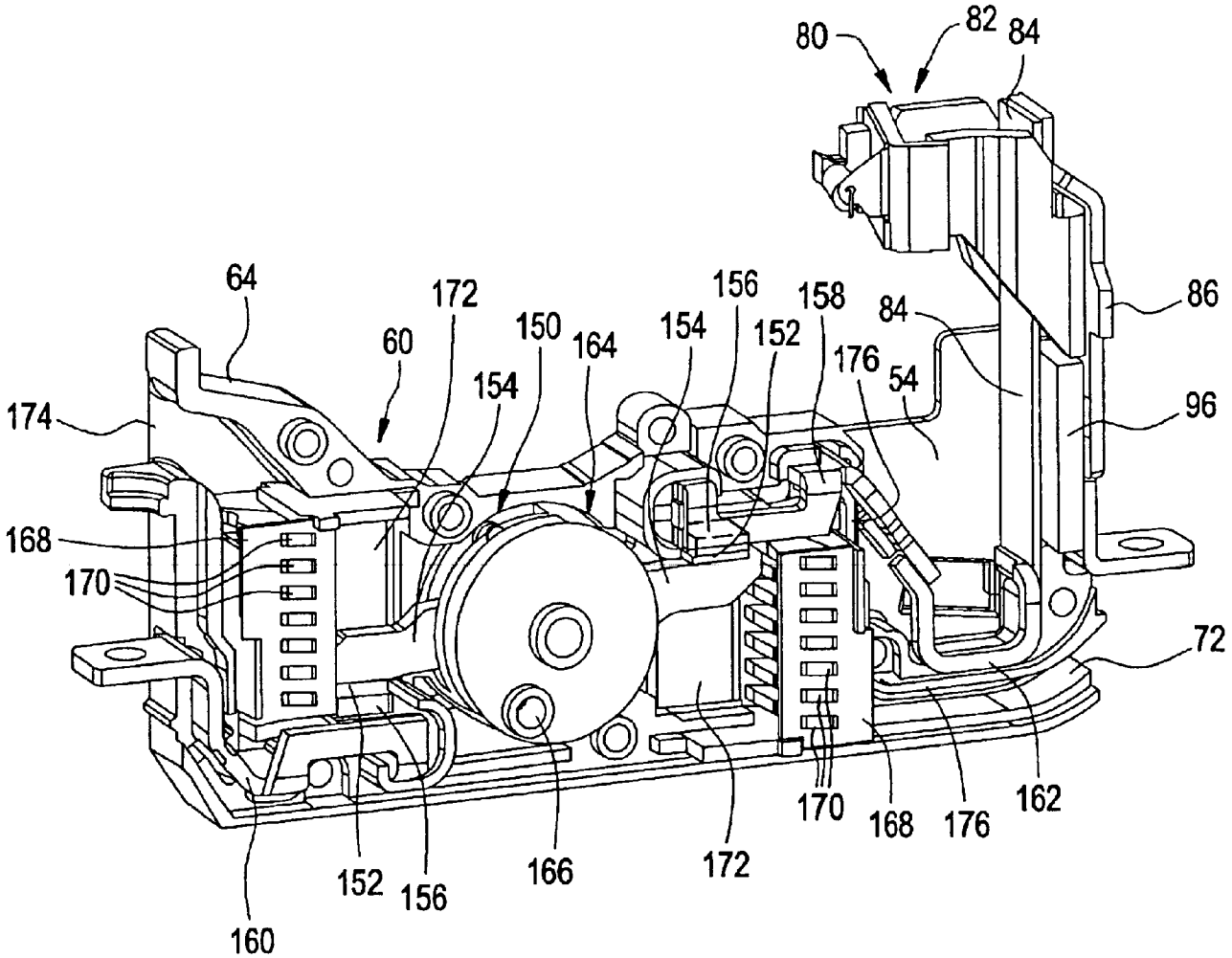
FIG. 5 is a partial cut-away view of the circuit breaker cassette including the integrated thermal and magnetic trip unit of FIG. 4.

Referring to FIG. 5, the cassette 32, 34, or 36 is shown with one half-piece 62 removed. Supported within cassette 32, 34, or 36 is a rotary contact assembly 150, which includes two mating pairs of electrical contacts, each pair having one contact 152 mounted on a contact arm 154 and another contact 156 mounted on one of a load strap 158 or a line strap 160. Load strap 158 is connected to a flexible braid 162, which is in turn coupled to an end of the bimetallic element 84. When the contacts 152, 156 are in a closed position (i.e., placed in intimate contact), electrical current passes between the line an load sides of the electrical distribution circuit through the line strap 160, the first pair of electrical contacts 152, 156, the contact arm 154, the second pair of electrical contacts 152, 156, the load strap 158, the flexible braid 162, the bimetallic element 84, and the load terminal 86.

The contact arm 154 is mounted within a rotor assembly 164, which is pivotally supported within the housing 60. A hole 166 in rotor assembly 164 accepts cross pin 40, which transmits the force of the operating mechanism 38 to pivot the rotor assembly 164 about its axis for separating the contacts 152, 156 to interrupt the flow of electrical current to the load terminal 86. The contact arm 154 may also pivot within the rotor assembly 164, thus allowing instantaneous separation of the contacts 152, 156 by the electromagnetic force generated in response to certain overcurrent conditions, such as dead short circuit conditions. The reverse loop shape of the line and load straps 158, 160 directs the electromagnetic force to separate the contacts 152, 156.

As the contacts 152, 156 move apart from each other to interrupt the flow of electrical current, an arc is formed between the contacts 152, 156, and the arc generates ionized gas. An arc arrestor 168 is supported in the housing proximate each pair of contacts 152, 156. The arc arrestor 168 includes a plurality of plates 170 disposed therein, which acts to attract, cool and de-ionize the arc to rapidly extinguish the arc. The gasses generated by the arc pass from a compartment 172 containing the contacts 152, 156, through the arc arrestor 168 and exhaust outside the housing 60 via ducts 72, 174. Duct 72 is formed adjacent to the compartment 54 for the integrated trip unit 80. A wall 176 extends inward from each of the sidewalls 46, 48 to form the duct 72 and to isolate the compartment 54 for the trip unit 80 from the compartment 172 including the contacts 152, 156. Other features that extend inward from each of the sidewalls 46, 48 include supports for the line and load straps 158, 160, support for the rotor assembly 164, and support for the arc arrestors 168.

Figure 6:
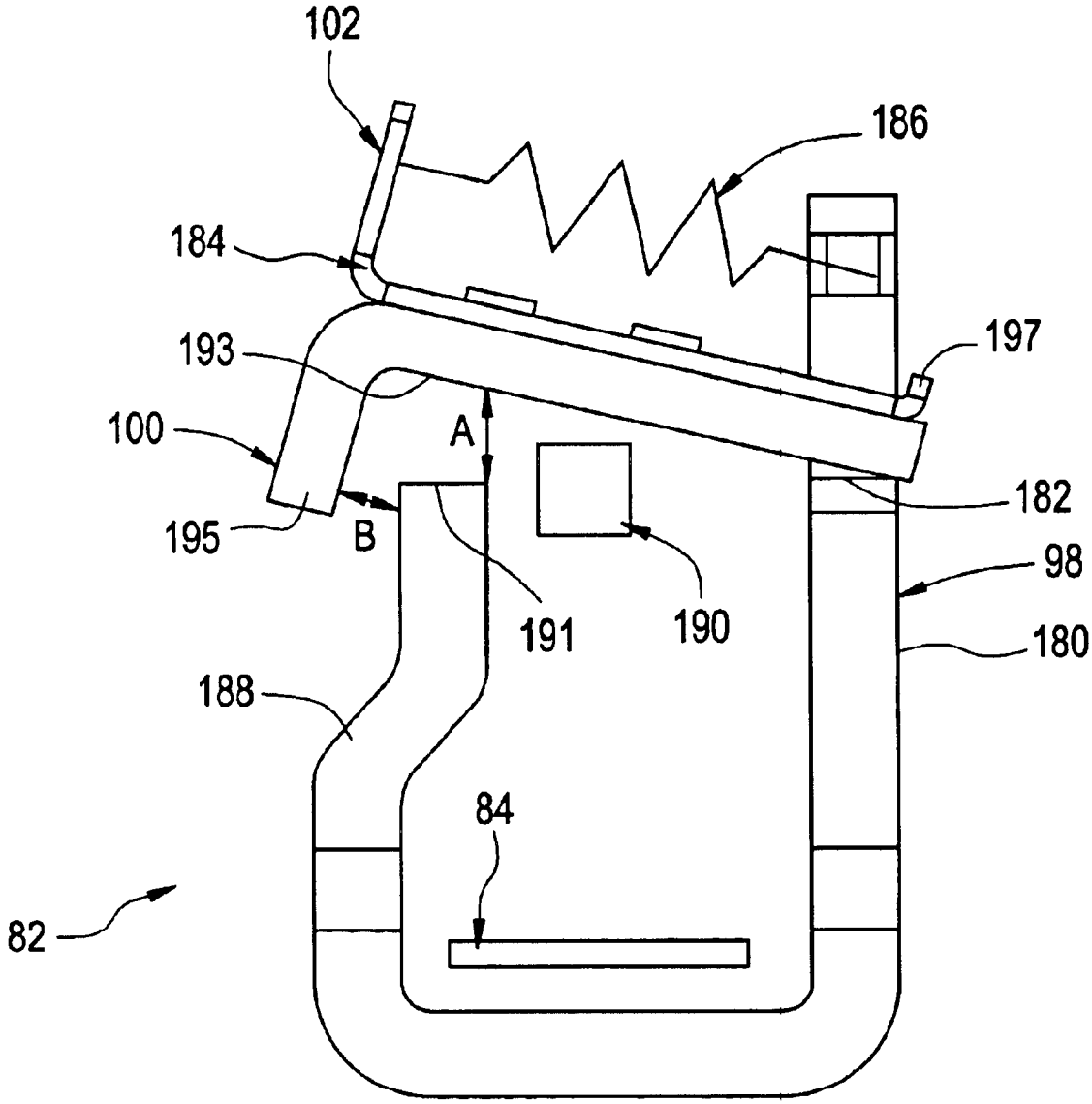
FIG. 6 is a plan view of a magnet assembly for the thermal and magnetic trip unit in an open position.

Referring to FIG. 6, a plan view of the magnet assembly 82 for the thermal and magnetic trip unit 80 is shown with the armature 100 in an open position. While magnet assembly 82 is described herein as forming part of thermal and magnetic trip unit 80 in a cassette type circuit breaker 20, it is contemplated that magnet assembly 82 may be used in any type of circuit breaker, with or without a bimetallic strip 84. The magnet assembly 82 includes core 98, which is disposed around a conductor forming a primary current path in the circuit breaker 20. In this embodiment, the conductor is the bimetallic element 84. The core 82 is generally U-shaped and includes legs 180, 188 disposed on either side of the bimetallic element 84. An end of leg 188 forms a pole face 191 of the core 82.

The armature 100 includes a generally planar surface 193 separated from the pole face 191 by a first air gap (A), and a projection 195 extending from the generally planar surface 193 toward the pole face 191. The projection 195 is separated from the pole face 191 by a second air gap (B). The first air gap (A) is larger than the second air gap (B). In the embodiment shown, the armature 100 is generally L-shaped, with one end of the armature being pivotally secured to the leg 180 of the core 98 and the other end forming the projection 195.

Armature 100 extends within an aperture 182 formed in the leg 180 of the magnet core 98 and is secured therein by a tab 197 disposed on an end of a bracket 184, which is fastened to the armature 100. A spring 186 extends between an opposite end of the bracket 184 and the leg 180 of the core 98 to provide a force bias the armature 100 in the open position, away from the pole face 191.

Figure 7:
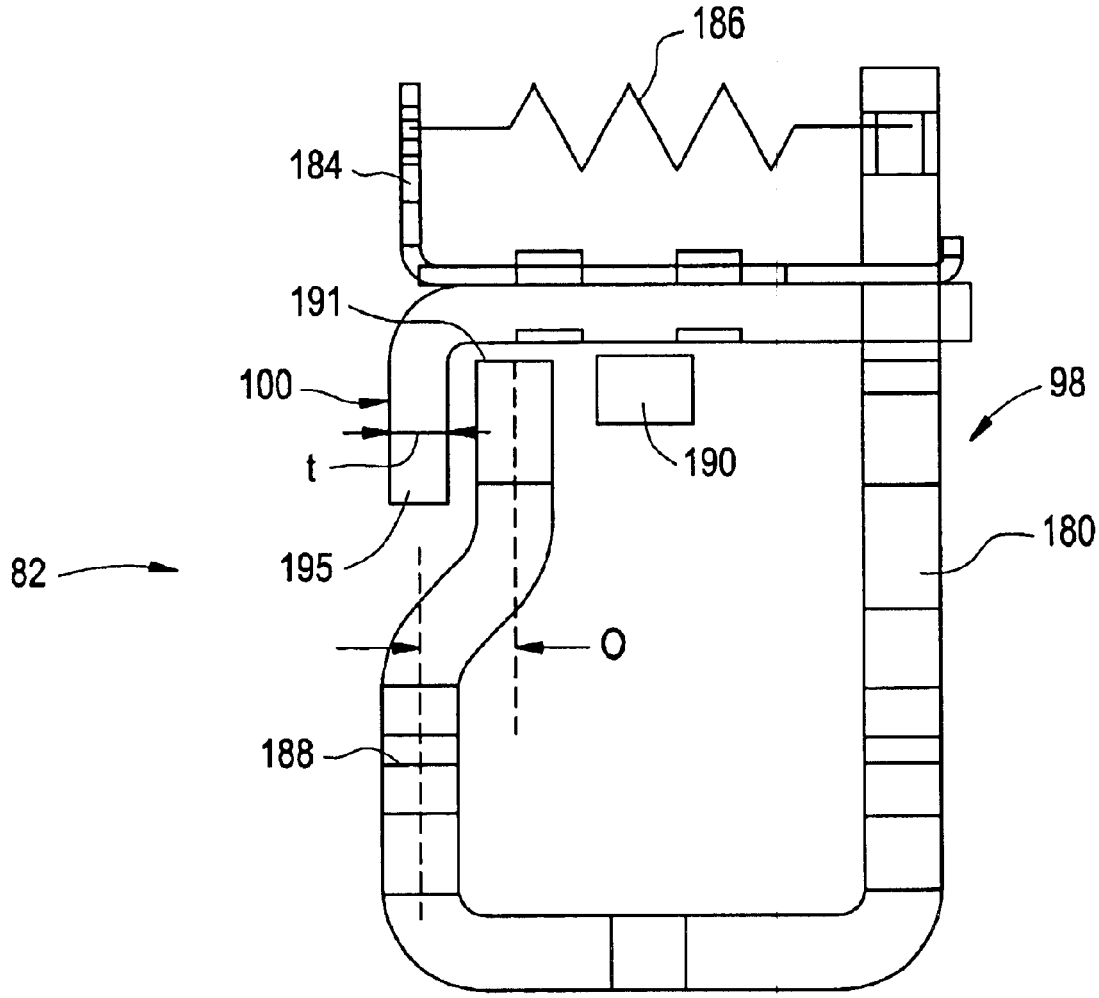
FIG. 7 is a plan view of the magnet assembly of FIG. 6 in a closed position.

As electrical current flows through the bimetallic element 84, a magnetic field is induced in the air gaps (A) and (B) which acts to attract the armature 100 toward the pole face 191. When the current exceeds a predetermined amount (e.g., 12.5 times the breaker current rating), the attractive force on the armature 100 overcomes the force applied by spring 186 and the armature 100 pivots about the leg 180 of the core 98 and accelerates the armature 100 to move toward a closed position, as shown in FIG. 7. As the armature 100 moves to the closed position, it contacts and moves the trip lever 190.

As shown in FIG. 7, a portion of the leg 188 of the core 98 including the pole face 191 is bent to offset the portion a distance "o" greater than about the thickness "t" of the projection 195. This offset allows the projection 195 to be received in a space formed by the offset such that the projection 195 does not contact the leg 188 as the armature 100 moves from the open position of FIG. 7 to the closed position of FIG. 8.

Figure 8:
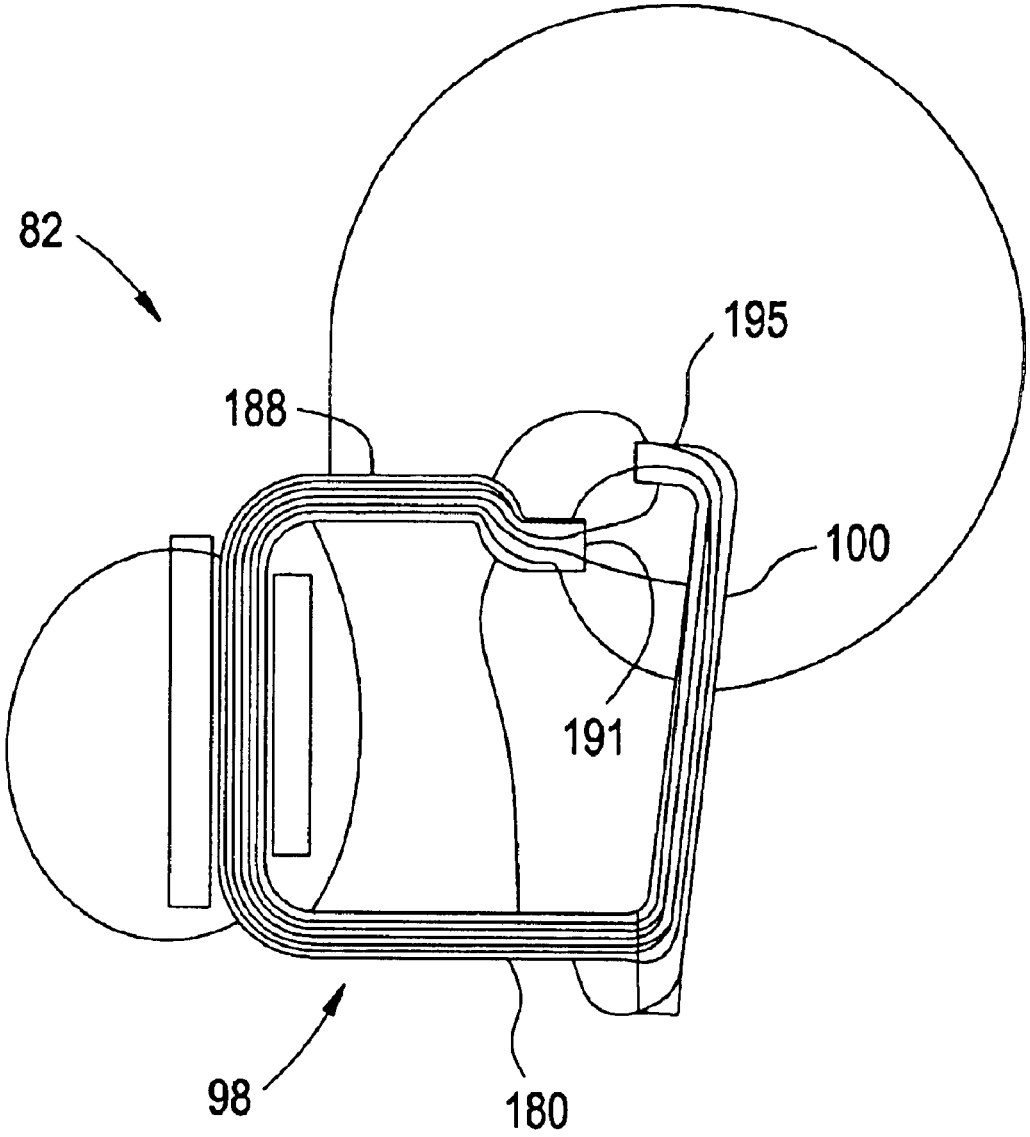
FIG. 8 is diagram showing the lines of magnetic flux indicated by an a computer model of the magnet assembly.

A computer analytical model of the magnet assembly 82 including an L-shaped armature 100 was created using commercially-available modeling software (MagNet from Infolytica Corp, Montreal, Quebec, Canada). FIG. 8 shows the lines of magnetic flux indicated by the analytical model of the magnet assembly 82. The results of the analytical model showed a 30% increase in the trip force generated by the armature 100 having the projection 195 (i.e., with two air gaps (A) and (B)) over the trip force generated by an armature with the flat-faced armature design of the prior art (i.e., with air gap (A) only) for the same size air gap (A). In addition, circuit breakers including the magnet assembly 82 having the L-shaped armature 100 were built and tested. The testing of the circuit breakers validated the results of the analytical model.

In sum, the analytical model of the magnet assembly 82 and the testing of circuit breakers including the magnet assembly 82 showed that the additional force created by the armature 100 having the projection 195 (i.e., with two air gaps (A) and (B)), is greater than the force that would be achieved by an armature with the flat-faced design of the prior art (i.e., with air gap (A) only). Thus, the armature 100 including the projection 195 (e.g., the L-shaped armature) results in higher forces at lower ampere ratings than can be achieved with the flat-faced design of the prior art. Indeed, the armature 100 including the projection 195 provides an adequate trip force at 12.5 times the circuit breaker ampere rating for current ratings 30 amps and above, which was previously achieved only with the use of a multi-turn coil.

In addition, the armature 100 having the projection 195 was shown to provide a higher, flatter force profile over the entire stroke of the armature 100 than would be achieved with the flat-faced design of the prior art (i.e., with air gap (A) only). As a result, the armature 100 including the projection 195 provides a more reliable design that is subject to less force variation with changes in air gap (A).

Figure 9:
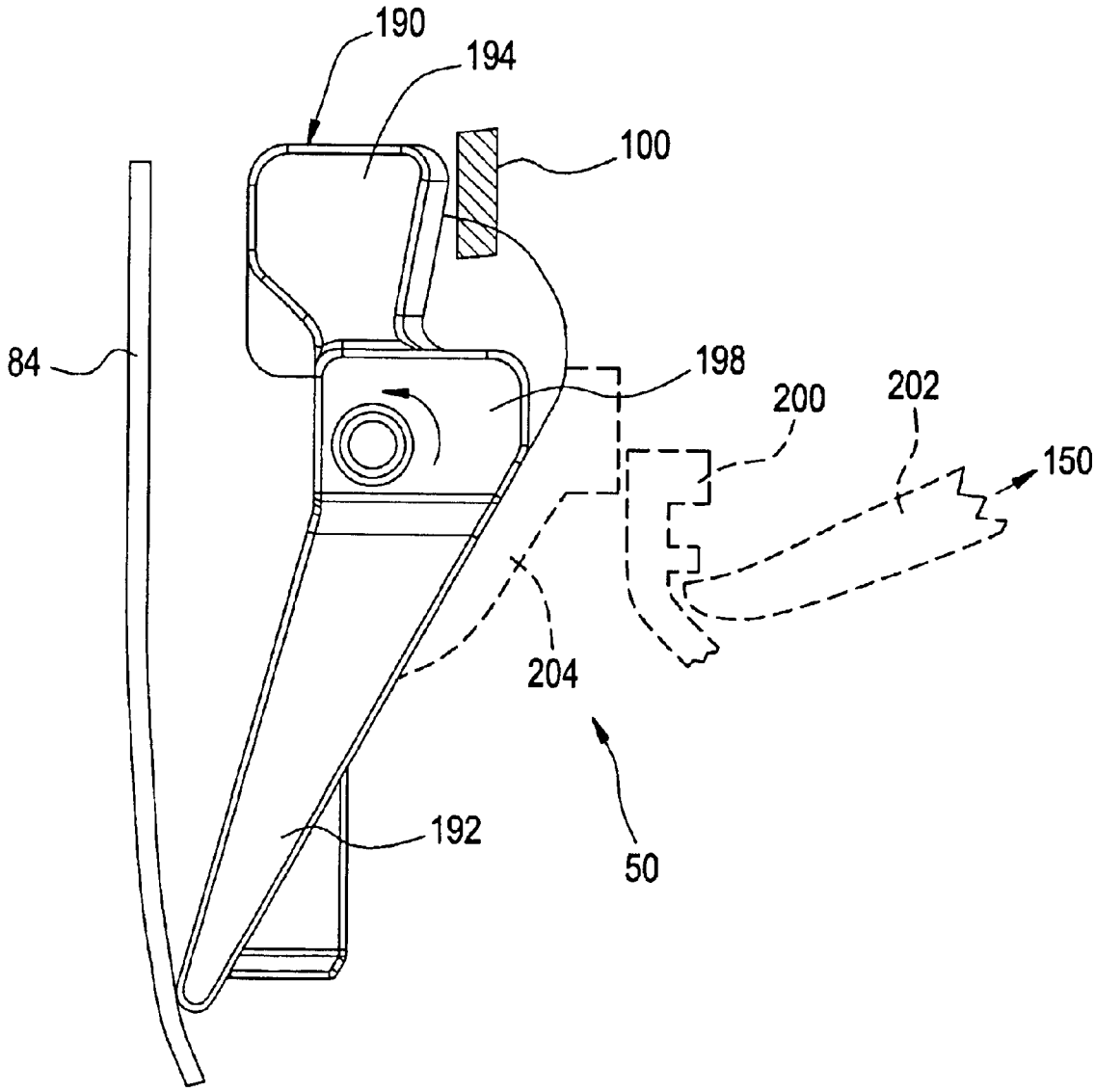
FIG. 9 is a schematic depiction of the thermal and magnetic trip unit and a trip lever of the operating mechanism.
Figure 10:
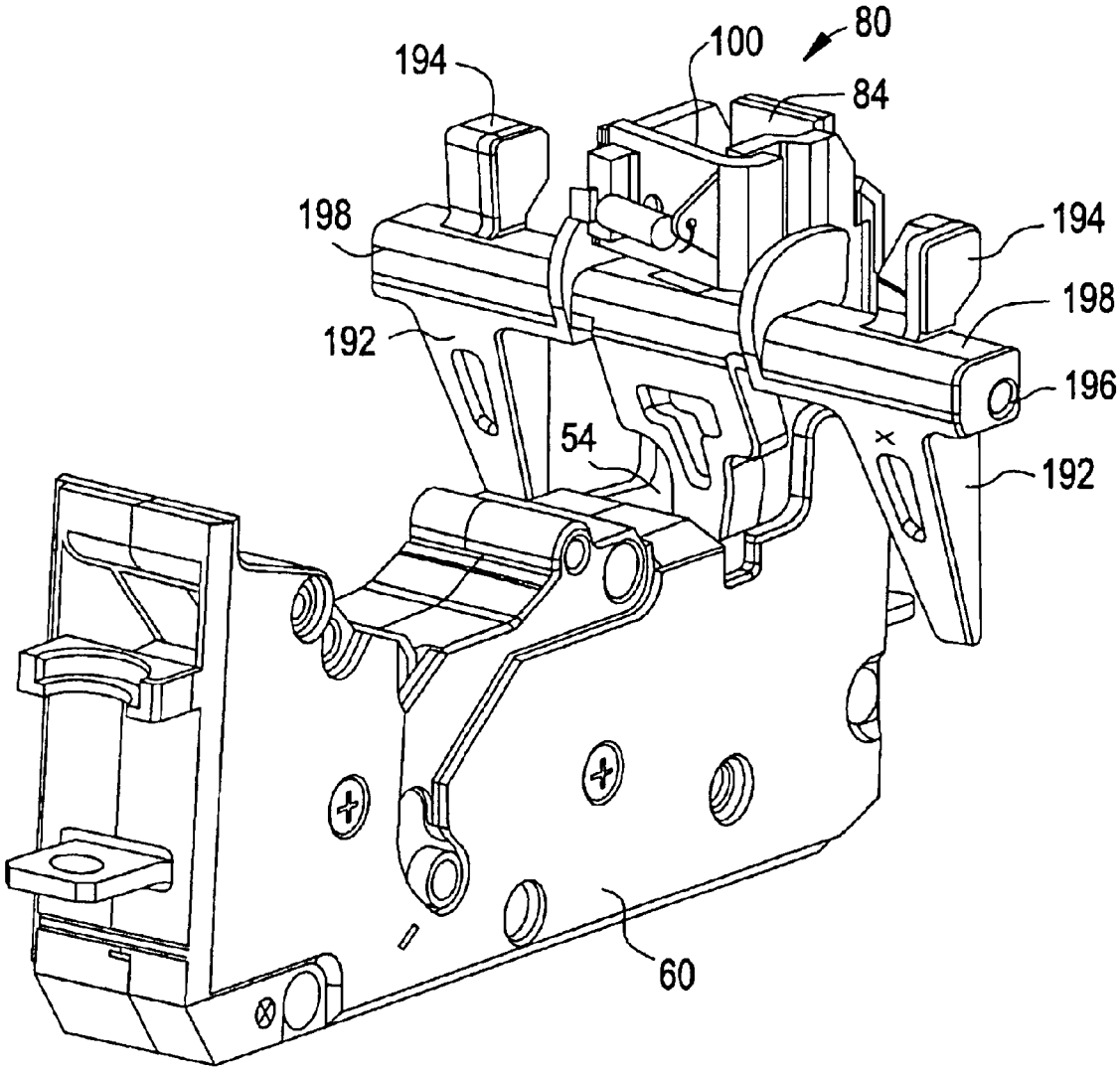
FIG. 10 is a perspective view of the trip lever positioned relative to a cassette housing.

FIG. 9 is a schematic depiction of the interaction between the thermal and magnetic trip unit 80 and the trip lever 190. FIG. 10 is a perspective view of the trip lever positioned relative to a cassette housing 60. As shown in FIG. 9 and FIG. 10, trip lever 190 includes a first end 192 extending from a bar 198 and disposed proximate an end of the bimetallic element 84, and a second end 194 extending from bar 198 and disposed proximate the armature 100. The trip lever 190 and the bimetallic element 84 extend into the compartment 54 through an opening in the top of the housing 60. As discussed above, movement of the armature 100 in response to a predetermined amount of current in the bimetallic element 84 causes the armature 100 to move the lever 190. The lever 190 may also be moved by the bimetallic element 84 itself, which forms the thermal portion of the thermal and magnetic trip unit 80. As current flows through the bimetallic element 84, the bimetallic element 84 heats up and bends due to the different coefficients of expansion in the metals used to form the bimetallic element 84. As the bimetallic element 84 bends due to increased temperature, it comes into contact and moves the trip lever 190.

Movement of the trip lever 190 by either the armature 100 or the bimetallic element 84 causes the trip lever 190 to rotate in the direction indicated by the arrow about a pivot point 196. Trip lever 190 may be coupled to the trip latch system 50 of the operating mechanism 38 using any suitable arrangement such that rotation of the trip lever 190 will cause the spring mechanism 51 to become unlatched to separate the contacts 152, 156. For example, the trip latch system 50 may operate as described in U.S. Pat. No. 6,218,919 entitled "Circuit Breaker Latch Mechanism With Decreased Trip Time" where trip latch system 50 would include a primary latch 200 releasably coupled to the operating mechanism 38 via a cradle 202 and biased against a secondary latch 204 affixed to trip lever 190 such that rotation of the trip lever 190 (in the direction indicated by the arrow) by either the bimetallic element 84 or armature 100 will cause the secondary latch 204 to pivot away from and out of contact with the primary trip latch 200. Without secondary latch 204 to restrain movement of the primary latch 200, the primary latch 200 moves to release the cradle 202 and, thus, unlatch the spring mechanism 51, which, in turn, separates the electrical contact pairs 152, 156 in each of the cassettes 32, 34, and 36. As best seen in FIG. 10, bar 198 includes a number of trip levers 190 disposed thereon equal to the number of cassettes 32, 34 and 36 in the circuit breaker 20. Thus, the movement of any trip lever 190 will cause rotation of the bar 198 about pivot point 196 to trip the circuit breaker 20.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A magnet assembly for actuating a trip latch in a circuit breaker, the magnet assembly including:

a core disposed around a conductor forming a primary current path in the circuit breaker, the core including an end forming a pole face;

an armature biased by a force acting in a direction away from the pole face, the armature including:

a generally planar surface separated from the pole face by a first air gap, and a projection extending from the generally planar surface toward the pole face, the projection being separated from the pole face by a second air gap, the first air gap being larger than the second air gap, wherein a magnetic field induced in the first and second air gaps by the passage of electrical current through the conductor moves the armature against the force to actuate the trip latch.

2. The magnet assembly of claim 1, wherein the armature is pivotally secured to the core proximate an opposite end of the core.

3. The magnet assembly of claim 2, wherein the armature is generally L-shaped, with one end of the armature being pivotally secured proximate the opposite end of the core and the other end forming the projection.

4. The magnet assembly of claim 3, wherein the force is applied by a spring coupled between the armature and the opposite end of the core.

5. The magnet assembly of claim 4, further comprising:

a bracket secured to the armature, the spring extending between the bracket and the opposite end of the core.

6. The magnet assembly of claim 5, wherein and end of the bracket and the one end of the armature extend through an aperture in the opposite end of the core, the bracket including a tab extending therefrom for retaining the armature and the bracket within the aperture.

7. The magnet assembly of claim 1, wherein the core is generally U-shaped.

8. The magnet assembly of claim 7, wherein a portion of a leg of the core including the pole face is bent to offset the portion of the leg a distance greater than about the thickness of the projection, the projection being received in a space formed by the offset.

9. The magnet assembly of claim 8, wherein the armature is generally L-shaped, with one end of the armature being pivotally secured proximate the opposite end of the core and the other end forming the projection.

10. A circuit breaker including:

a trip latch; and a magnet assembly for actuating the trip latch, the magnet assembly including:

a core disposed around a conductor forming a primary current path in the circuit breaker, the core including an end forming a pole face;

an armature biased by a force acting in a direction away from the pole face, the armature including:

a generally planar surface separated from the pole face by a first air gap, and a projection extending from the generally planar surface toward the pole face, the projection being separated from the pole face by a second air gap, the first air gap being larger than the second air gap, wherein a magnetic field induced in the first and second air gaps by the passage of electrical current through the conductor moves the armature against the force to actuate the trip latch.

11. The circuit breaker of claim 10, wherein the armature is pivotally secured to the core proximate an opposite end of the core.

12. The circuit breaker of claim 11, wherein the armature is generally L-shaped, with one end of the armature being pivotally secured proximate the opposite end of the core and the other end forming the projection.

13. The circuit breaker of claim 12, wherein the force is applied by a spring coupled between the armature and the opposite end of the core.

14. The circuit breaker of claim 13, further comprising:

a bracket secured to the armature, the spring extending between the bracket and the opposite end of the core.

15. The circuit breaker of claim 14, wherein and end of the bracket and the one end of the armature extend through an aperture in the opposite end of the core, the bracket including a tab extending therefrom for retaining the armature and the bracket within the aperture.

16. The circuit breaker of claim 10, wherein the core is generally U-shaped.

17. The circuit breaker of claim 16, wherein a portion of a leg of the core including the pole face is bent to offset the portion of the leg a distance greater than about the thickness of the projection, the projection being received in a space formed by the offset.

18. The circuit breaker of claim 17, wherein the armature is generally L-shaped, with one end of the armature being pivotally secured proximate the opposite end of the core and the other end forming the projection.

* * * * *